US008109695B2

(12) United States Patent
Chiou

(10) Patent No.: US 8,109,695 B2
(45) Date of Patent: Feb. 7, 2012

(54) CONCRETE PILE INSTALLATION APPARATUS

(76) Inventor: Chi-Iung Chiou, Changhua County (TW)

( * ) Notice: Subject to any disclaimer, the term of this patent is extended or adjusted under 35 U.S.C. 154(b) by 63 days.

(21) Appl. No.: 12/796,832

(22) Filed: Jun. 9, 2010

(65) Prior Publication Data

US 2011/0305524 A1 Dec. 15, 2011

(51) Int. Cl.
*E02D 7/02* (2006.01)

(52) U.S. Cl. ..... 405/232; 173/170

(58) Field of Classification Search ..... 405/232, 405/245; 173/34, 44, 170
See application file for complete search history.

(56) References Cited

U.S. PATENT DOCUMENTS

| | | | | | |
|---|---|---|---|---|---|
| 3,279,195 | A * | 10/1966 | Taylor | 405/232 |
| 3,657,896 | A * | 4/1972 | Ishihara et al. | 405/232 |
| 3,866,425 | A * | 2/1975 | Morrice | 405/274 |
| 4,709,764 | A * | 12/1987 | Gibbons | 173/45 |
| 5,040,927 | A * | 8/1991 | Wickberg | 405/232 |
| 5,304,015 | A * | 4/1994 | Sonomura | 405/232 |
| 5,407,304 | A * | 4/1995 | Glass et al. | 405/279 |
| 6,368,023 | B1 * | 4/2002 | Lau | 405/232 |
| 7,381,010 | B2 * | 6/2008 | Alexander et al. | 405/233 |

* cited by examiner

*Primary Examiner* — Tara Mayo-Pinnock
(74) *Attorney, Agent, or Firm* — Rosenberg, Klein & Lee

(57) ABSTRACT

A concrete pile installation apparatus includes a pile clamping unit having stop plates arranged at different elevations and hand wheel-controlled clamping blocks disposed corresponding to the stop plates and operable to clamp concrete piles for installation and rollers that facilitate adjustment of the position of concrete piles, and two racks that use hydraulic cylinders to support the pile clamping unit and to adjust the elevation of the pile clamping unit and the clamped concrete piles.

3 Claims, 9 Drawing Sheets

CONCRETE PILE INSTALLATION APPARATUS

BACKGROUND OF THE INVENTION

1. Field of the Invention

The present invention relates to concrete fence wall installation technology and more particularly, to a concrete pile installation apparatus, which facilitates installation of concrete piles, saving much concrete pile installation labor and time.

2. Description of the Related Art

Conventionally, a concrete fence wall is established, as shown in FIG. 1, by: making pile holes on the ground at selected locations, and then mounting concrete piles 1 in the pile holes, and then inserting concrete slabs 3 into the longitudinal grooves 2 of each two adjacent concrete piles 1. According to this method, concrete piles are individually installed in the pile holes. During installation, rule and wire are used to assist vertical angle and horizontal position measurement. This method has drawbacks as follows:

1. Concrete piles are to be installed individually. Rule and wire must be used to assist vertical angle and horizontal position measurement, requiring much labor and time and increasing the installation cost.
2. If one concrete pile 1 biased in one respective pile hole 4 due to a human error, as shown in FIGS. 2 and 3, the operators will be unable to insert concrete slabs 3 into the longitudinal grooves 2 of the corresponding concrete piles 1 accurately. In this case, the concrete pile 1 must be removed from the respective pile hole 4 and re-installed.

SUMMARY OF THE INVENTION

The present invention has been accomplished under the circumstances in view. It is one object of the present invention to provide a concrete pile installation apparatus, which comprises a pile clamping unit that has stop plates arranged at different elevations and hand wheel-controlled clamping blocks disposed corresponding to the stop plates and operable to clamp concrete piles for installation and rollers that facilitate adjustment of the position of concrete piles. By means of the concrete pile installation apparatus, multiple concrete piles can be installed at a time, saving much concrete pile installation labor and time.

It is one object of the present invention to provide a concrete pile installation apparatus, which further comprises two racks that use hydraulic cylinders and rollers to support the pile clamping unit, allowing adjustment of the pile clamping unit and the clamped concrete piles vertically as well as horizontally.

DETAILED DESCRIPTION OF THE PREFERRED EMBODIMENT

Figure 1:
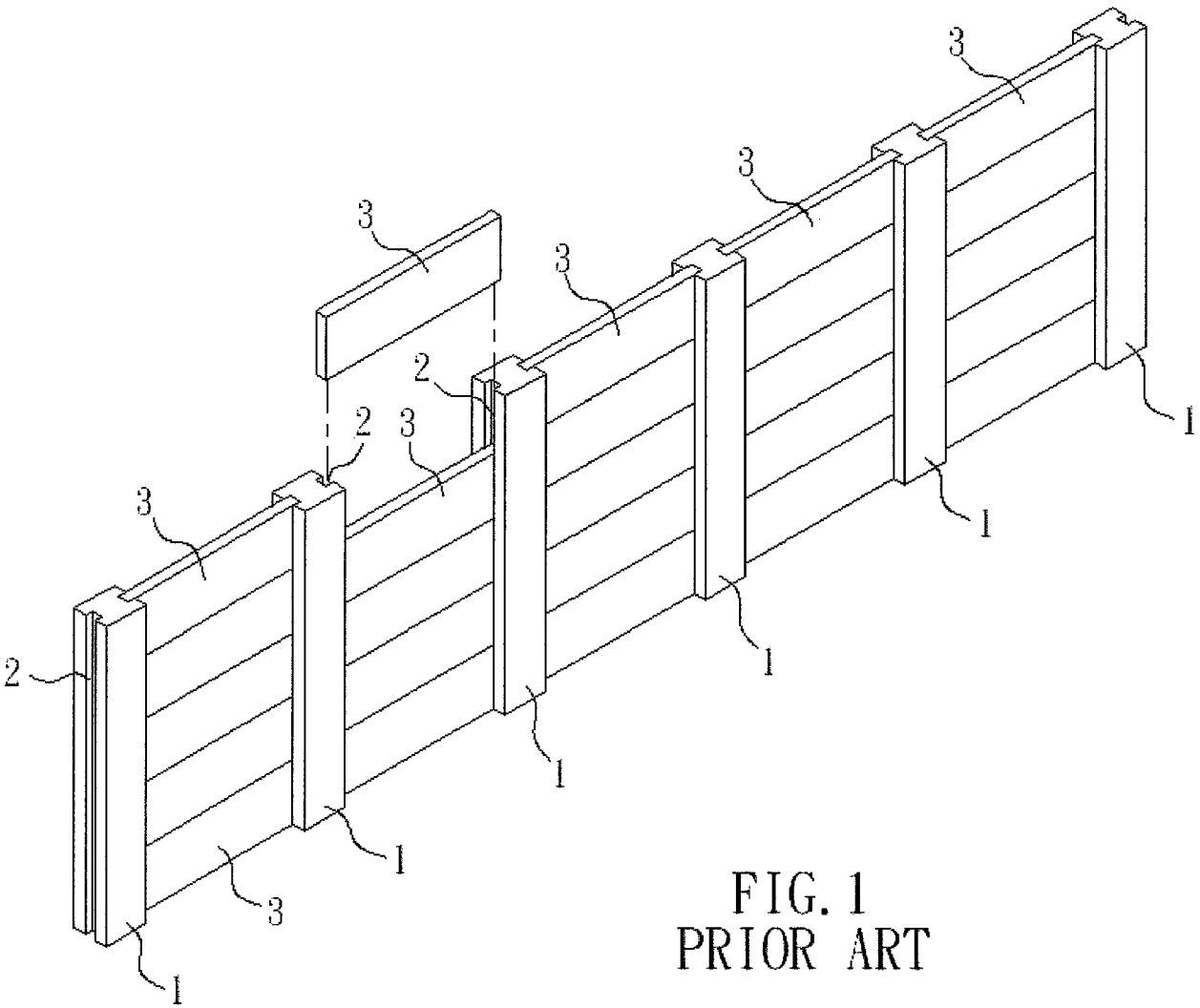
FIG. 1 PRIOR ART
FIG. 1 illustrates the installation of a concrete fence wall according to the prior art.
Figure 2:
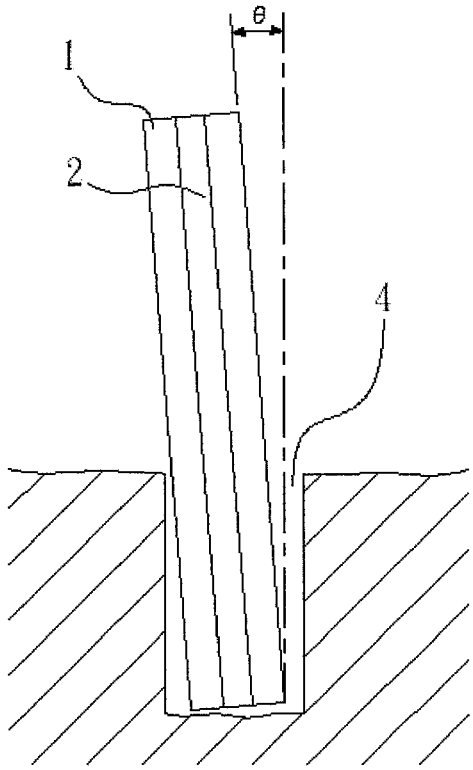
FIG. 2 PRIOR ART
FIG. 2 is a schematic drawing showing one concrete pile biased in the pile hole according to the prior art.
Figure 3:
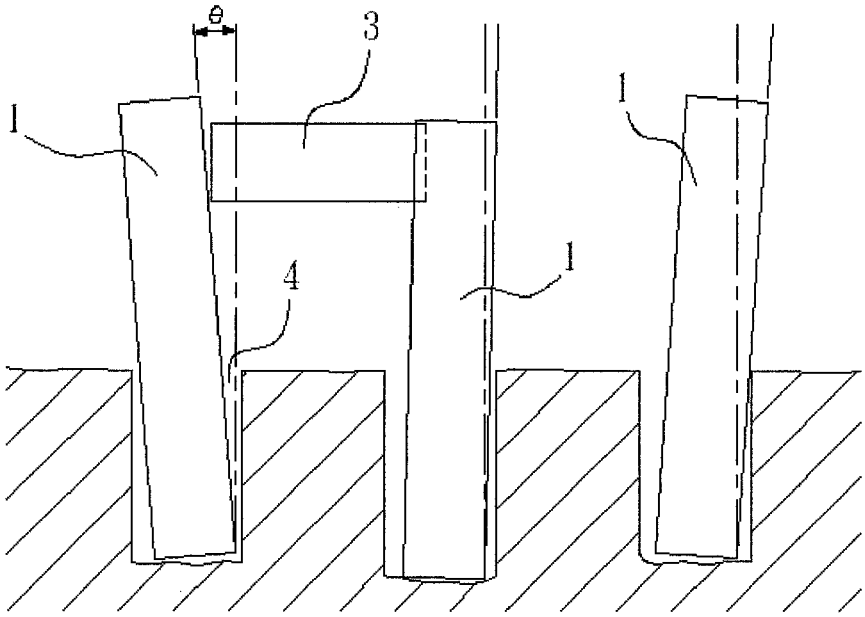
FIG. 3 PRIOR ART
FIG. 3 is a schematic drawing showing a concrete pile biased and concrete slab installation failed according to the prior art.
Figure 4:
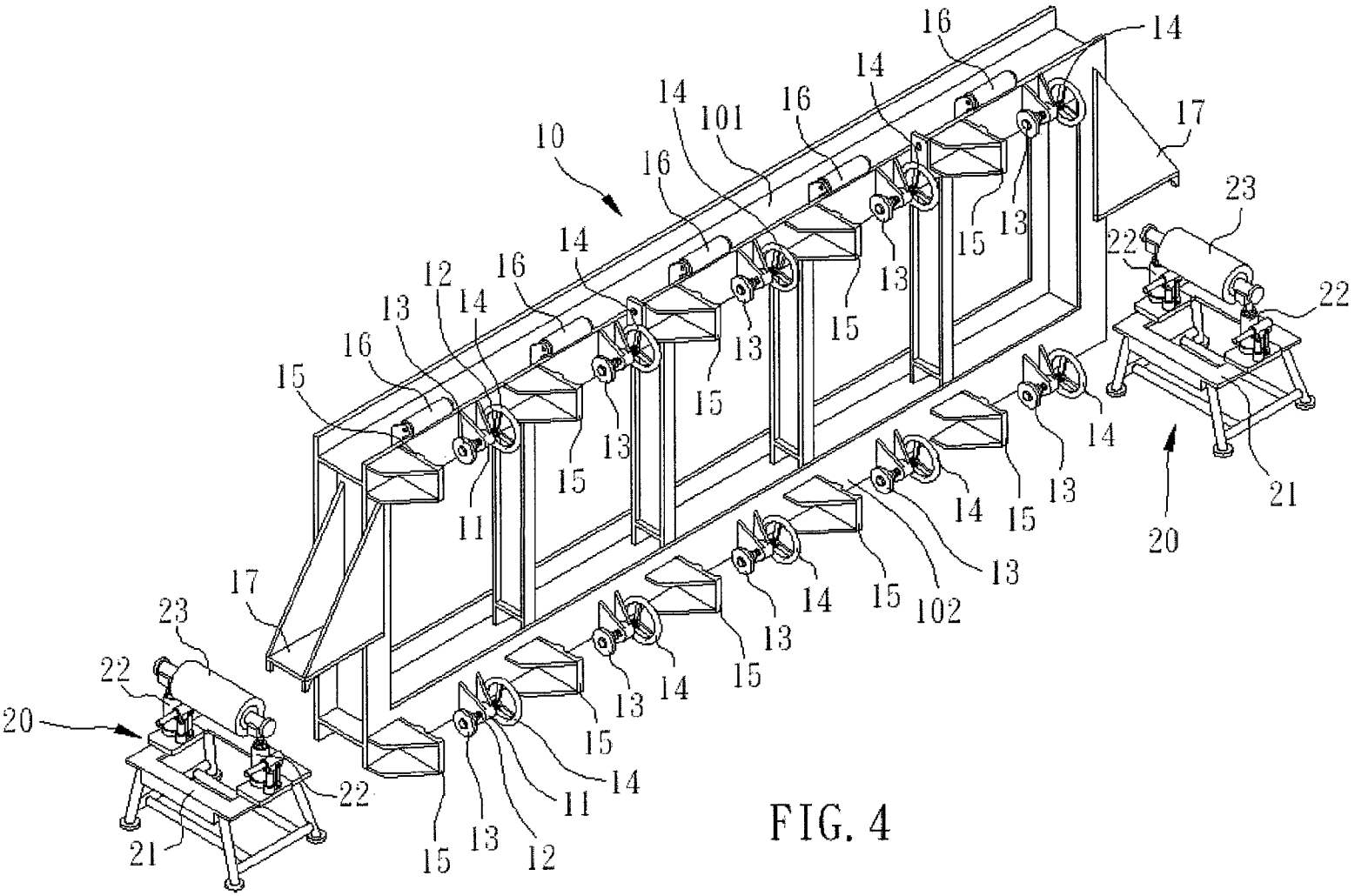
FIG. 4 is an exploded view of a concrete pile installation apparatus in accordance with the present invention.

Referring to FIGS. 4-8, a concrete pile installation apparatus in accordance with the present invention is shown comprising two racks 20 and a pile clamping unit 10.

The pile clamping unit 10 comprises an upper beam 101, a lower beam 102, a plurality of stop plates 15 symmetrically fixedly located on each of the upper and lower beams 101; 102, a plurality of plurality of screw holders 11 symmetrically fixedly located on each of the upper and lower beams 101;102 corresponding to the stop plates 15, a screw rod 12 rotatably mounted in each of the screw holders 11, a clamping block 13 fixedly located on one end of each screw rod 12, a hand wheel 14 fixedly located on the other end of each screw rod 12 and operable to rotate the associating screw rod 12 and to further move the associating clamping block 13 toward or away from the associating stop plate 15 for clamping a concrete pile 1 or releasing the clamped concrete pile 1, a plurality of rollers 16 pivotally mounted on the upper beam 101 and respectively disposed between the stop plates 15 and the screw holders 11 at the upper beam 101, and two side plates 17 symmetrically disposed at two opposite lateral sides and supportable on the racks 20. Each rack 20 comprises a flat top 21, two vertical hydraulic cylinders 22 mounted on the flat top 21 and a roller 23 supported on the vertical hydraulic cylinder 22 and movable up and down by the vertical hydraulic cylinders 22. The two side plates 17 of the pile clamping unit 10 are supported on the rollers 23 of the racks 20.

Figure 5:
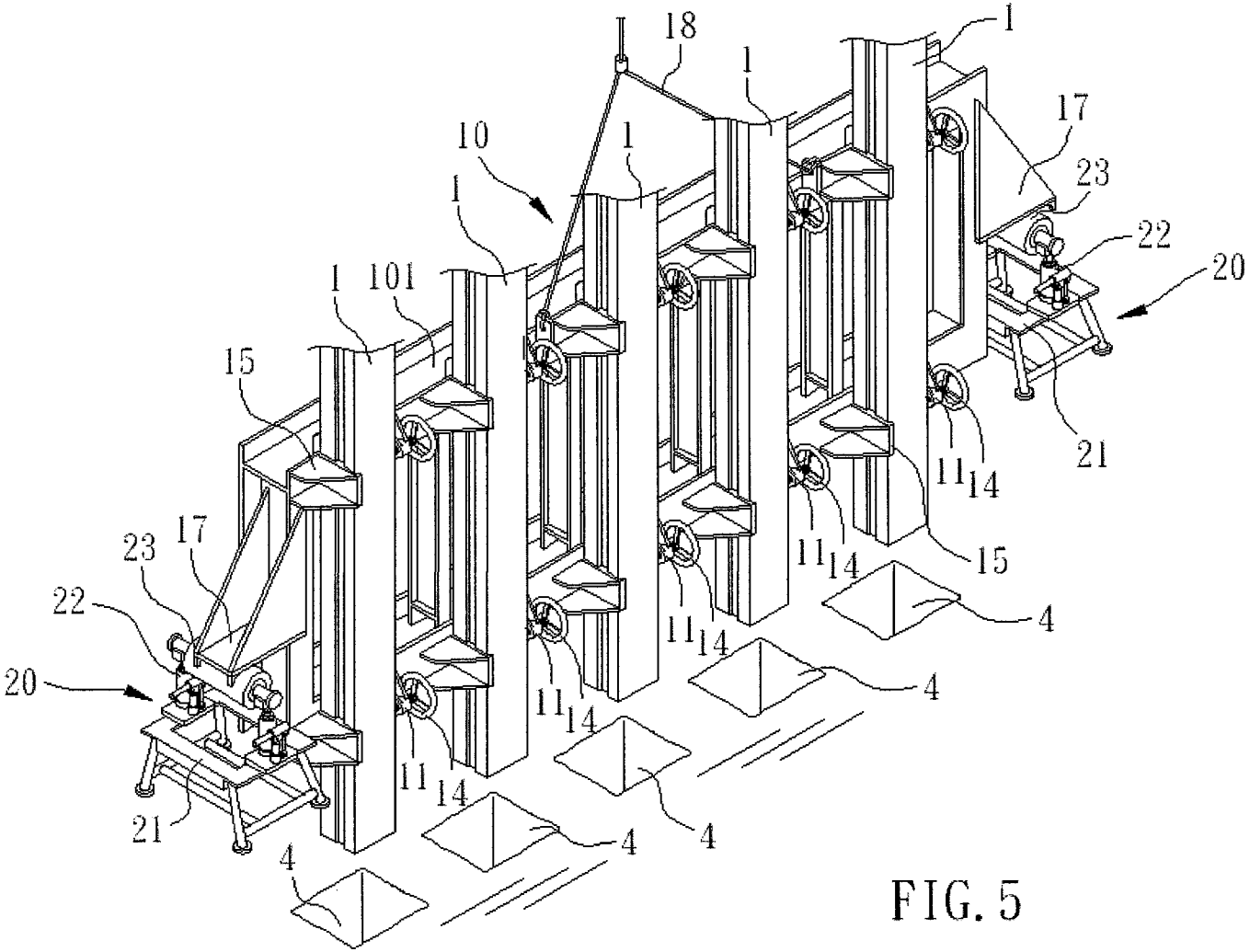
FIG. 5 is a schematic drawing showing an application status of the present invention.
Figure 6:
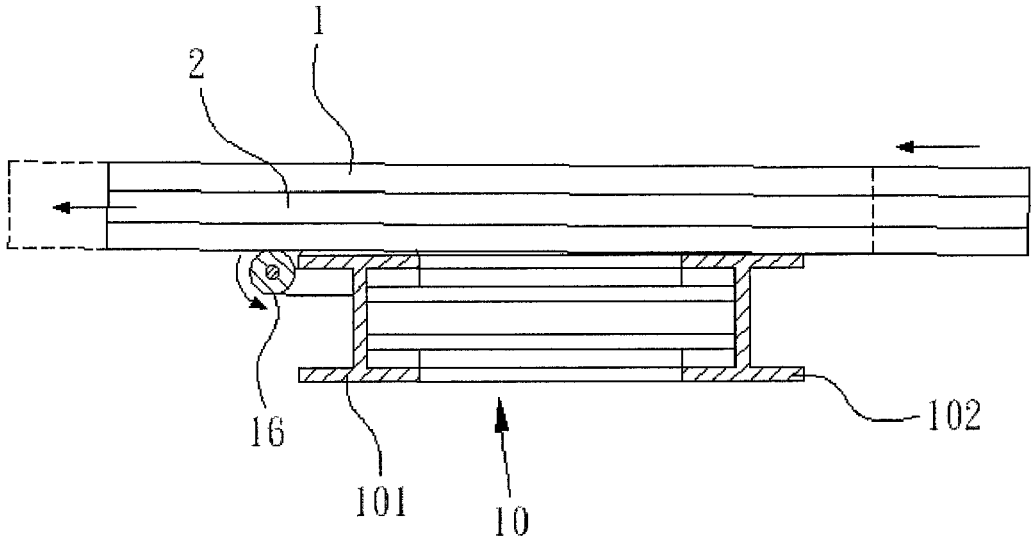
FIG. 6 is a schematic drawing of a part of the present invention, showing one concrete pile supported in the pile clamping unit and adjusted.
Figure 7:
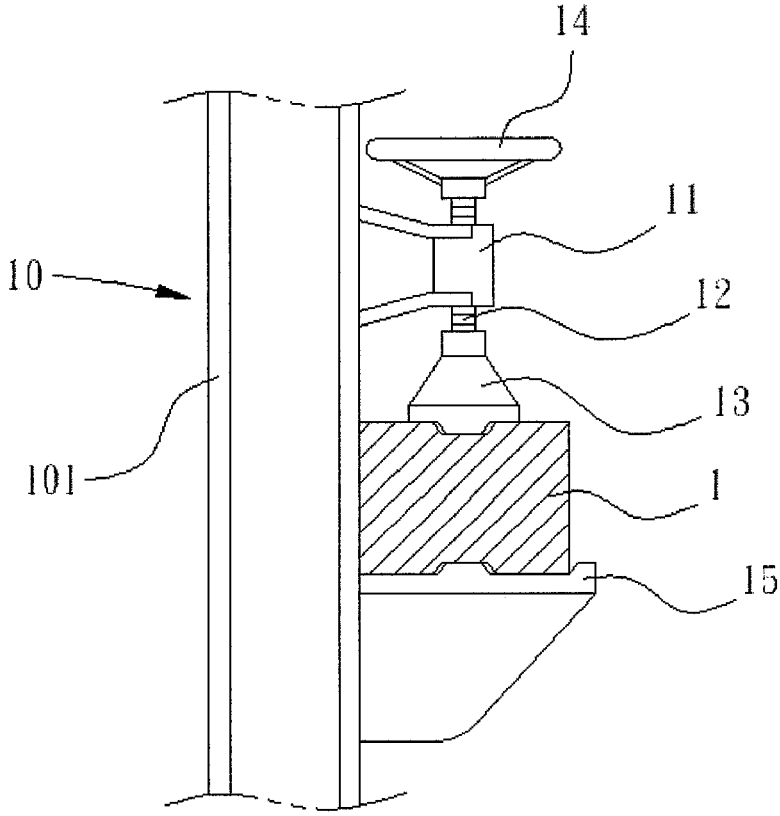
FIG. 7 is a schematic top view of a part of the present invention, showing a concrete pile clamped in the pile clamping unit.
Figure 8:
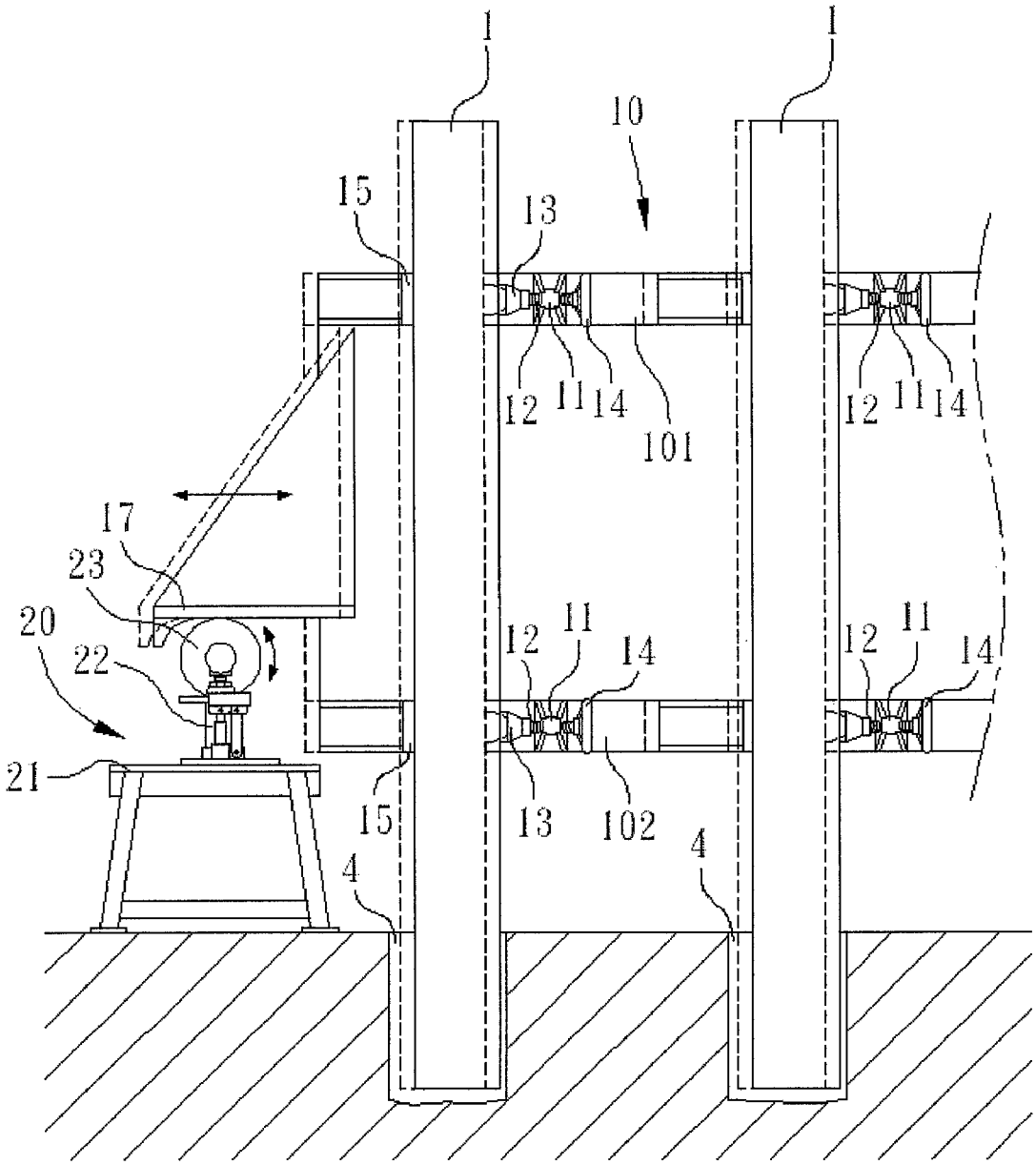
FIG. 8 is a schematic drawing of the present invention, showing the pile clamping unit supported on the racks and adjusted horizontally.

When in use, as shown in FIG. 6, place the pile clamping unit 10 horizontally on the ground, and then set concrete piles 1 between the stop plates 15 and the clamping blocks 13 respectively for enabling the concrete piles 1 to be supported on the rollers 16 and adjusted to the desired position, and then operate the hand wheels 14 to rotate the associating screw rods 12 and to further move the associating clamping blocks 13 toward the associating stop plates 15, thereby clamping the concrete piles 1. Thereafter, use a steel rope 18 and a crane to lift the pile clamping unit 10 and the clamped concrete piles 1, as shown in FIGS. 5 and 8, for enabling the concrete piles 1 to be inserted vertically into respective pile holes 4 on the ground. At this time, the two side plates 17 of the pile clamping unit 10 are respectively supported on the rollers 23 of the racks 20. Thereafter, operate the vertical hydraulic cylinder 22 to adjust the elevation of the rollers 23 and the pile clamping unit 10, thereby adjusting the insertion depth of the concrete piles 1 in the respective pile holes 4. Further, because the pile clamping unit 10 is supported on the rollers 23 of the racks 20, adjustment of the horizontal position of the pile clamping unit 10 is easy.

As stated above, the pile clamping unit 10 can clamp multiple concrete piles 1 at a time. Subject to the functioning of the rollers 16 and the vertical hydraulic cylinder 22 and rollers 23 of the racks 20, the clamped concrete piles 1 can be adjusted vertically as well as horizontally to the accurate position. Therefore, the invention facilitates accurate and rapid installation of concrete piles, saving much installation labor and time.

Figure 9:
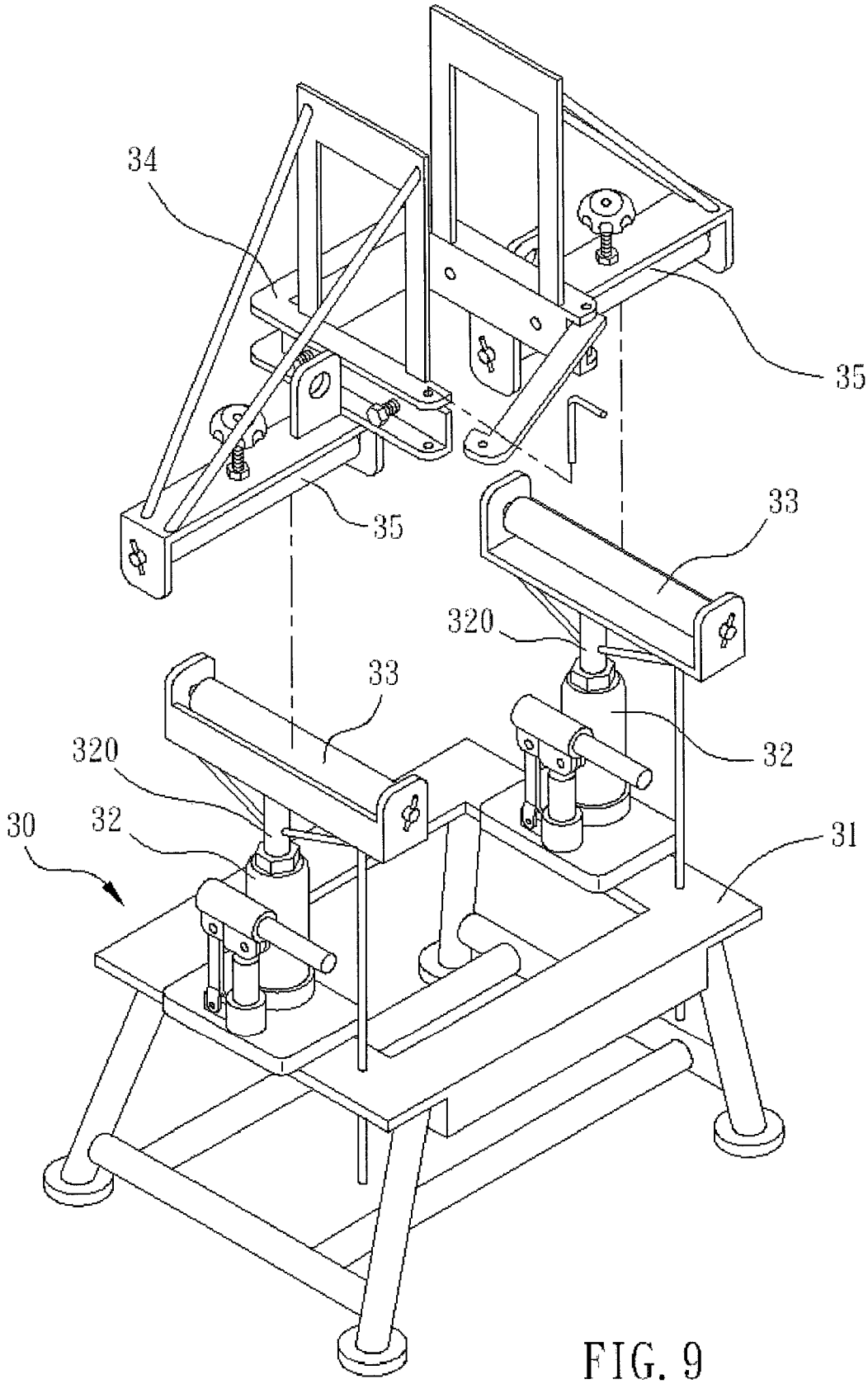
FIG. 9 is an exploded view of an alternate form of the rack in accordance with the present invention.
Figure 10:
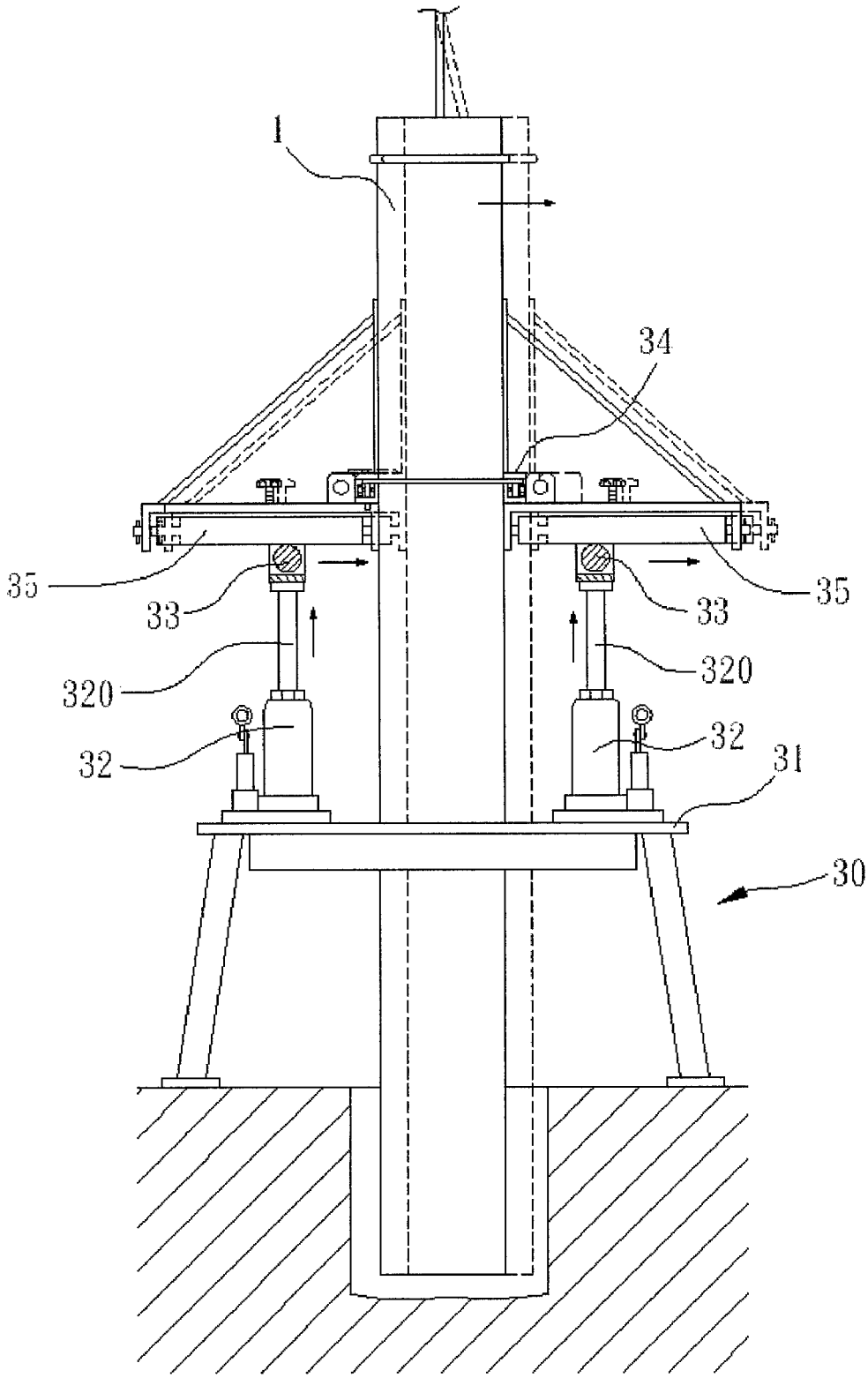
FIG. 10 is a schematic front view of the present invention, showing an operation status of the alternate form of the rack.
Figure 11:
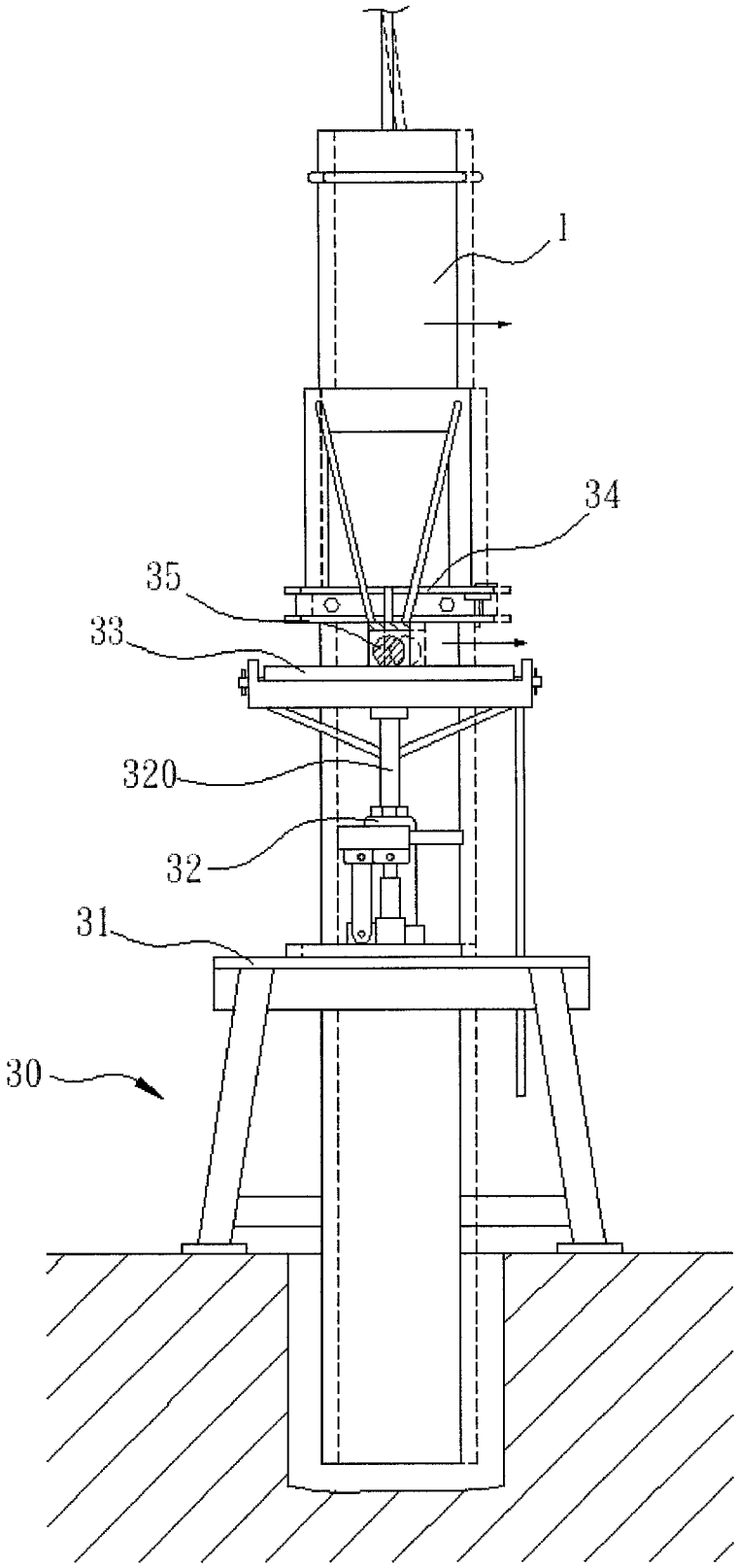
FIG. 11 is a schematic side view of the present invention, showing an operation status of the alternate form of the concrete pile installation apparatus.

FIGS. 9-11 show an alternate form of the rack practical for use in the installation of a non-linear or arched concrete fence wall. According to this alternate form the rack 30 comprises a flat top 31, two vertical hydraulic cylinders 32 mounted on the flat top 31, and a roller 33 supported on the top end of the reciprocating rod 320 of each vertical hydraulic cylinder 32 and movable up and down the reciprocating rod 320 of the vertical hydraulic cylinders 32, a pile holder 34 for holding a concrete pile 1, and two supplementary rollers 35 located on the bottom side of the pile holder 34 and respectively supported on the rollers 33 at the reciprocating rods 320 of the vertical hydraulic cylinders 32. During application, as shown in FIGS. 10 and 11, a concrete pile 1 is supported on the pile holder 34. By means of rotating the rollers 33, as shown in FIG. 10, the concrete pile 1 can be adjusted leftwards or rightwards to the desired position. By means of rotating the supplementary rollers 35, as shown in FIG. 11, the concrete pile 1 can be adjusted forwards or backwards to the desired position.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A concrete pile installation apparatus, comprising:

two racks; and a pile clamping unit, said pile clamping unit comprising an upper beam, a lower beam, a plurality of stop plates symmetrically fixedly located on each of said upper beam and said lower beam, a plurality of screw holders symmetrically fixedly located on each of said upper beam and said lower beam corresponding to said stop plates, a screw rod rotatably mounted in each said screw holder, a clamping block fixedly located on one end of each said screw rod, a hand wheel fixedly located on an opposite end of each said screw rod and operable to rotate the associating screw rod and to further move the associating clamping block relative to the associating stop plate for clamping a concrete pile, and two side plates symmetrically disposed at two opposite lateral sides and supportable on said racks.

2. The concrete pile installation apparatus as claimed in claim 1, wherein each said rack comprising a flat top, two vertical hydraulic cylinders mounted on said flat top and roller means supported on said vertical hydraulic cylinders for supporting the side plates of said pile clamping unit and movable up and down by said vertical hydraulic cylinders.

3. The concrete pile installation apparatus as claimed in claim 1, wherein said pile clamping unit further comprises a plurality of rollers pivotally mounted on said upper beam and respectively disposed between the stop plates and the screw holders at said upper beam.

* * * * *